US008464502B2

(12) United States Patent
Spiekers et al.

(10) Patent No.: US 8,464,502 B2
(45) Date of Patent: Jun. 18, 2013

(54) PACKAGING DEVICE FOR PACKING STACKED SOFT HYGIENIC PRODUCTS INTO A PLASTIC BAG

(75) Inventors: Stephan Spiekers, Frankenhardt (DE); Geert Ivo Coletta Maria Cloostermans-Huwaert, Hamme (BE); Andre Josephine Karel De Saert, Hamme (BE); Markus Port, Steinbach am (DE); Ibrahim Ulas, Steinbach am (DE); Thomas Reinhold Albert Wessel, Ellwangen (DE)

(73) Assignee: The Procter and Gamble Company, Cincinnati, OH (US)

( * ) Notice: Subject to any disclaimer, the term of this patent is extended or adjusted under 35 U.S.C. 154(b) by 433 days.

(21) Appl. No.: 12/792,866

(22) Filed: Jun. 3, 2010

(65) Prior Publication Data

US 2010/0307114 A1 Dec. 9, 2010

(30) Foreign Application Priority Data

Jun. 5, 2009 (EP) ..... 09007477

(51) Int. Cl.

| | |
|---|---|
| ***B65B 9/06*** | (2006.01) |
| ***B65B 35/50*** | (2006.01) |
| ***B65B 51/26*** | (2006.01) |
| ***B65B 63/02*** | (2006.01) |

(52) U.S. Cl.

USPC ..... 53/550; 53/530; 53/540

(58) Field of Classification Search

CPC .. B65B 9/06; B65B 51/26; B65B 35/50; B65B 63/026

USPC ..... 53/530, 540, 542, 550

IPC ..... B65B 9/06,35/50, 51/26, 63/02

See application file for complete search history.

(56) References Cited

U.S. PATENT DOCUMENTS

| | | | | |
|---|---|---|---|---|
| 3,932,981 | A * | 1/1976 | Fillmann et al. | 53/529 |
| 4,696,147 | A | 9/1987 | Noh | |
| 4,761,937 | A | 8/1988 | Francioni | |
| 4,875,328 | A * | 10/1989 | Meyer | 53/529 |
| 5,155,979 | A | 10/1992 | McDonald | |
| 5,406,773 | A * | 4/1995 | Limousin | 53/550 |
| 5,564,261 | A | 10/1996 | Kiner | |
| 6,615,567 | B2 * | 9/2003 | Kuhn et al. | 53/551 |

FOREIGN PATENT DOCUMENTS

| | | | |
|---|---|---|---|
| DE | 4245062 | B4 * | 8/2007 |
| EP | 721886 | A1 * | 7/1996 |
| EP | 0 627 355 | B1 | 8/1997 |
| EP | 1270416 | A1 * | 1/2003 |
| EP | 1619128 | A1 * | 1/2006 |
| GB | 2 403 198 | A | 12/2004 |
| GB | 2403198 | A * | 12/2004 |
| JP | 06099915 | A * | 4/1994 |
| WO | WO 2005025993 | A1 * | 3/2005 |

* cited by examiner

OTHER PUBLICATIONS

PCT International Search Report for PCT/US2010/037177, mailed Sep. 24, 2010, 4 pages.

*Primary Examiner* — Stephen F Gerrity

(74) *Attorney, Agent, or Firm* — Andrew J. Hagerty; Megan C. Hymore

(57) ABSTRACT

A packaging device for packing stacked soft hygienic products, e.g. sanitary napkins, panty liners or the like, into a plastic bag made of an endless film, has specific forming shoulder (21) and MD sealing unit (5) to produce a MD seal (35) at a closure edge (46) of the bag. Thus four integral side panels are available at the bag (WB) for imprinting.

8 Claims, 11 Drawing Sheets

PACKAGING DEVICE FOR PACKING STACKED SOFT HYGIENIC PRODUCTS INTO A PLASTIC BAG

FIELD OF THE INVENTION

The invention refers to a packaging device and method for packing stacked soft hygienic products e.g. diapers or feminine care products such as sanitary napkins, panty liners or the like, into a plastic bag made of an endless polymer film.

BACKGROUND OF THE INVENTION

In the field of packing techniques, it is known from prior use that for an in-line production of plastic bags made of an endless film and containing stacked soft hygienic products a stack forming unit for bundling product items to a stack is provided. By means of a stack transport unit the formed stack is supplied to a wrapping station. The latter comprises a supply tunnel through which the formed stacks are delivered to the wrapping station in a row. To pack the incoming stacks a polymer film is used which is supplied by means of a film feed unit from the film stock, like a film roll.

To wrap the film web around the stacks, a funnel-shaped forming shoulder arranged around the supply tunnel is provided, which has a substantially rectangular cross section design. The fed film is drawn over this forming shoulder and guided onto the supply tunnel forming a tube-like film envelope around the stacks leaving the supply tunnel. Usually, the funnel-shaped forming shoulder shows a symmetric design so that the longitudinally running edges of the tube-like film envelope around the stacks are located in the centerline of one of the side faces of the bag. Accordingly, a machine direction (abbreviated "MD" in the following) sealing unit seals these longitudinally—running edges thus leading to a plastic weld seam on the associated side face of the bag.

Finally, to complete the plastic bag around one stack of hygienic products a cross direction (abbreviated "CD" in the following) sealing unit is used for forming and sealing the crosswise running edges of the tube-like film envelope for each plastic bag, simultaneously separating the sequenced bags.

Due to the side face centered weld seam applied by the MD sealing unit, this side face is lost for any imprint fully covering this side face without being disturbed by the weld seam.

WO97/20737 discloses method and apparatus for feeding resiliently compressed articles to a form/fill/seal machine.

Plastic bags for feminine hygiene articles having one single MD seal along one corner of the bag have been sold in Asia. However it is believed that these bags have been produced using a process wherein the plastic film used has been presealed in the MD direction and folded at least once before being fed into the packing line. A folding line in the center of a side panel is therefore visible in these finished plastic bags.

It is an object of the invention to simplify the production of plastic bags containing stacked soft hygienic products. It is another object of the invention to provide an improved packaging device for packing stacked soft hygienic products by means of plastic bags comprising four completely printable side faces in the MD direction.

SUMMARY OF THE INVENTION

The invention relates to a packaging device comprising the characterizing features of claim 1 according to which the funnel-shaped forming shoulder has an asymmetric shape to guide the longitudinally running edges of the film to align with one longitudinal corner of the supply tunnel and the stacks, respectively, and the MD sealing unit is located in the vicinity of said longitudinal corner to produce an MD seal at the plastic bag running along a longitudinal closure corner of each plastic bag.

Due to the asymmetrically funnel-shaped forming shoulder it is possible to guide the film for forming the tube-like envelope in such a way that the longitudinally running edges of the film align with one longitudinal corner of the respective stack. The MD sealing unit is accordingly displaced to a side so that the produced MD seal at the plastic bag is running along the according longitudinal closure corner of each plastic bag. Apparently, all four MD side faces of the bag are thus free from any weld seam thus giving the possibility to print texts and images on all four side faces in a high quality.

According to an advantageous embodiment of the invention, the funnel edges of the forming shoulder terminate at the MD corners of the supply tunnel. Furtheron, it is possible to design the top surface of the forming shoulder as an oblique chute which might be completed by an idle roller for the film supplied from the stock role which idle roller is located in front of the oblique chute.

All the aforesaid design features serve to optimize the guiding of the film and the forming of the tube-like envelope around the stacks delivered via the supply tunnel.

According to another advantageous embodiment, the MD sealing unit comprises a pair of cooperating sealing rollers which form a sealing gap in front of the longitudinal closure corner for the longitudinally running edges of the tube-like film envelope of the plastic bag. The parallel axis of rotation of these sealing rollers take an acute angle versa the adjacent side walls of the plastic bag. Due to this construction the longitudinally running edges are gripped in a reliable manner as they extend from the longitudinal closure corner in a least possible deflection.

By means of the integrated circular cutting blade the steps of sealing the film edges and of trimming the produced weld seam are integrated in one sealing and trimming tool.

According to a further advantageous embodiment, at least one pulling unit is arranged lengthwise of the tube-like film envelope to transport same in synchronism with the stacks leaving the supply tunnel. This design helps to neatly guide the tube-like film envelope with the same speed as the stacks delivered from the supply tunnel. Advantageously, the pulling unit may be realized by endless belt conveyors engaging the side portions of the tube-like film envelope. This leads to a high contact surface between the film envelope and the belt conveyors with a high friction due to the fact that belt conveyors are regularly made of rubber material.

The stack compressing unit described herein is a component of the packaging device which is advantageous for the packaging device with the wrapping station of the invention. However, it can also be used together with conventional bagging devices which do not lead to plastic bags with MD weld seams along the closure corner of the bag. In any case, compressing the stack of products before being fed into the plastic bag leads to product packaging with a reduced volume when packing a given number of product items. This means that shipping containers and storing room are decreased with increased cost efficiency. Furtheron, due to the compressed state of the stack, the plastic bag becomes more rigid and gets a well-defined cuboid shape.

Advantageously, the stack compressing unit comprises an elevator stage and a telescopic compartment thereon. The telescopic compartment is contractable by the elevating motion of the stage such that an uncompressed stack of product items produced by a stacker and loaded into the compartment is compressed and located in an elevated position to be supplied to the stack transport unit which may push the stack into the wrapping station of the packaging device.

For this purpose it is advantageous to position the compressed stacks in an upload position in front of the supply tunnel of the wrapping station.

In a further advantageous embodiment of the invention a push rod unit is provided which includes a push rod reciprocably driven to push the compressed stack through the supply tunnel into the tube-like film envelope formed by the wrapping station. The reciprocating drive of the push rod may be a servo motor connected to the push rod via an endless drive belt. This leads to a fast and perfectly controllable motion of the compressed stacks into and through the supply tunnel.

As concerns the elevator stage, it is advantageous to suspend same on an elevator bridge which is lifting and lowering the elevator stage and thus generating the compression function of the compartment accommodating the stack of products during its upward motion. Thus elevating and compressing the stack is achieved by a single machine stroke of the elevator stage.

Plastic bags may be produced on a packaging device according to the invention. Such a plastic bag advantageously comprises one single MD seal along one closure corner of the tube-like envelope surrounding the stack of products.

The stack of products contained in the closed plastic bag may advantageously be compressed in CD direction, that is in a direction perpendicular to MD, e.g. horizontal CD as represented in the Figures, but this may be also vertical CD. The compression degree (IBC) may be of at least 15%, or more, such as at least 20% or 25%. A range of from 20% to 30% may be most suitable. However, tests have shown that the in-bag degree of compression might reach 50%, i.e. the in-process degree of compression might even reach 70%.

Summing up, the novel packaging device and process can provide on-line made bags with MD seal in one corner edge in combination with high in-bag compression.

BRIEF DESCRIPTION OF THE DRAWINGS

Further features, details and advantages of the invention become apparent from the following description of an advantageous embodiment of a packaging device taken in conjunction with the accompanying drawings in which:

FIG. 7 shows a partial side elevation of the push rod unit, stack compressing unit, forming shoulder with supply tunnel and MD sealing unit, and.

DETAILED DESCRIPTION OF THE INVENTION

Figure 1:
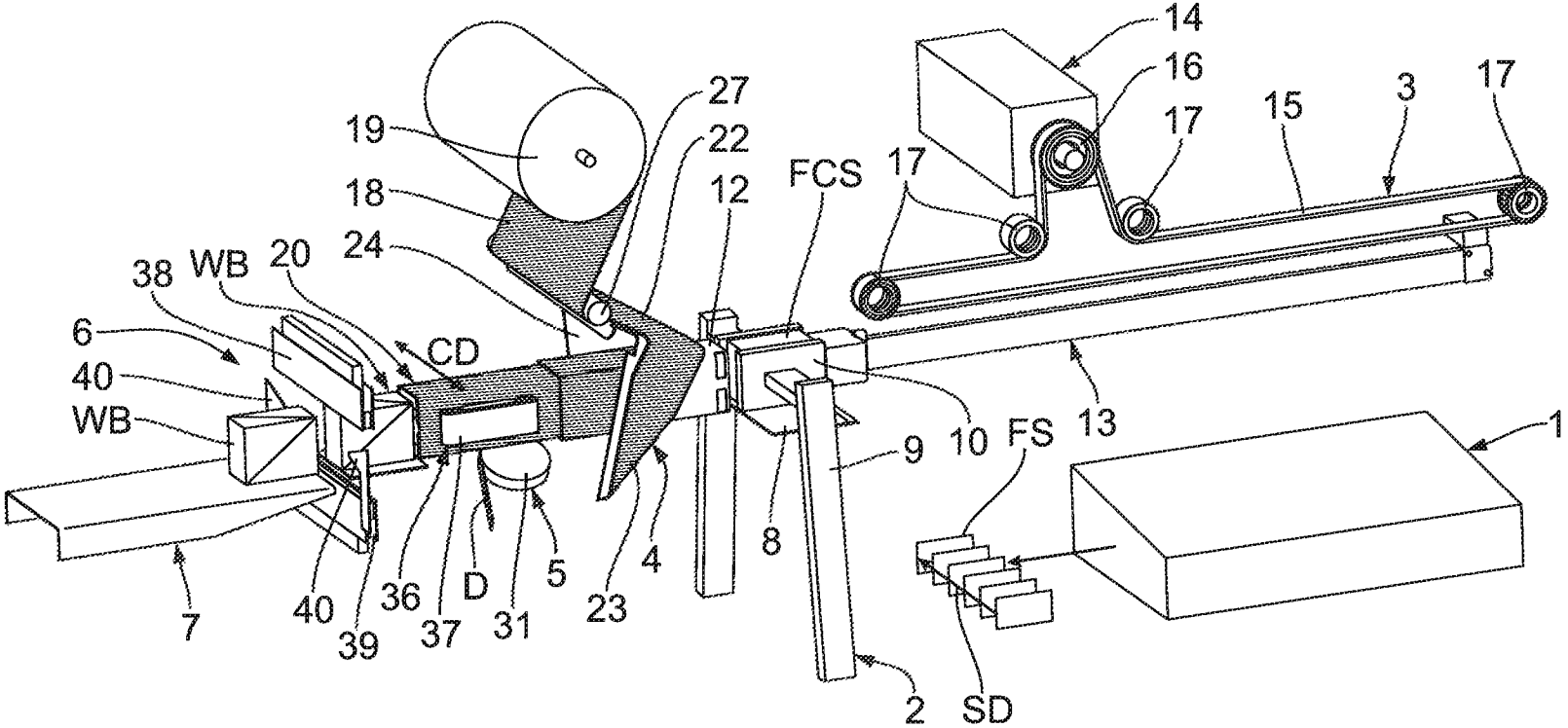
FIGS. 1 and 2 show perspective views of the packaging device.
Figure 2:
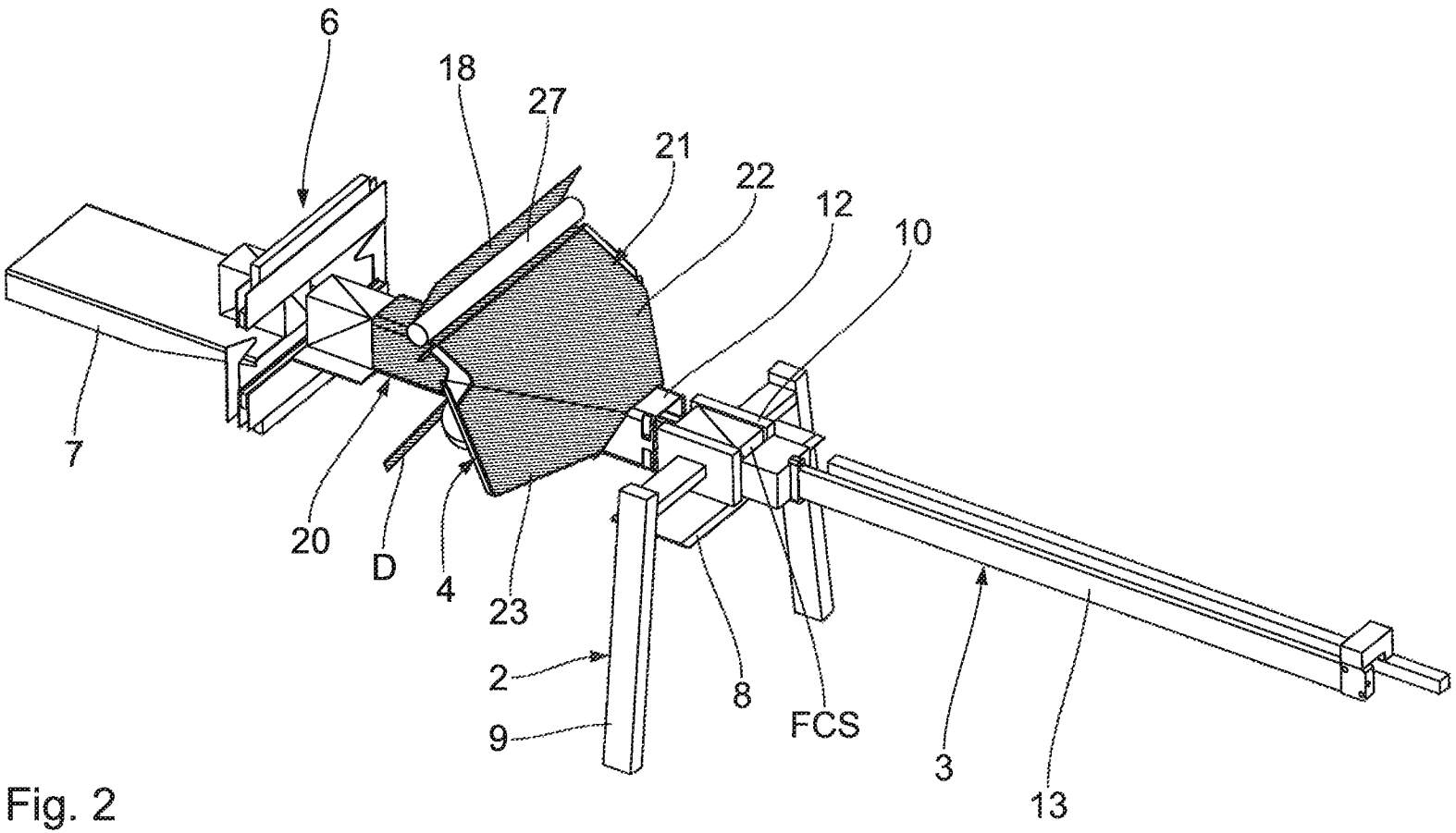

FIGS. 1 and 2 give a general overlook over the drawn packaging device. The main components are a stack forming unit 1 followed by a stack compressing unit 2. A stack transport unit 3 serves for supplying the formed and compressed stack FCS to a wrapping station 4 which cooperates with a machine direction—MD—sealing unit 5 and a cross direction—CD—sealing unit 6. The finished wrapped bags WB are finally removed from the packaging device by a schematically depicted removal unit 7.

Figure 4:
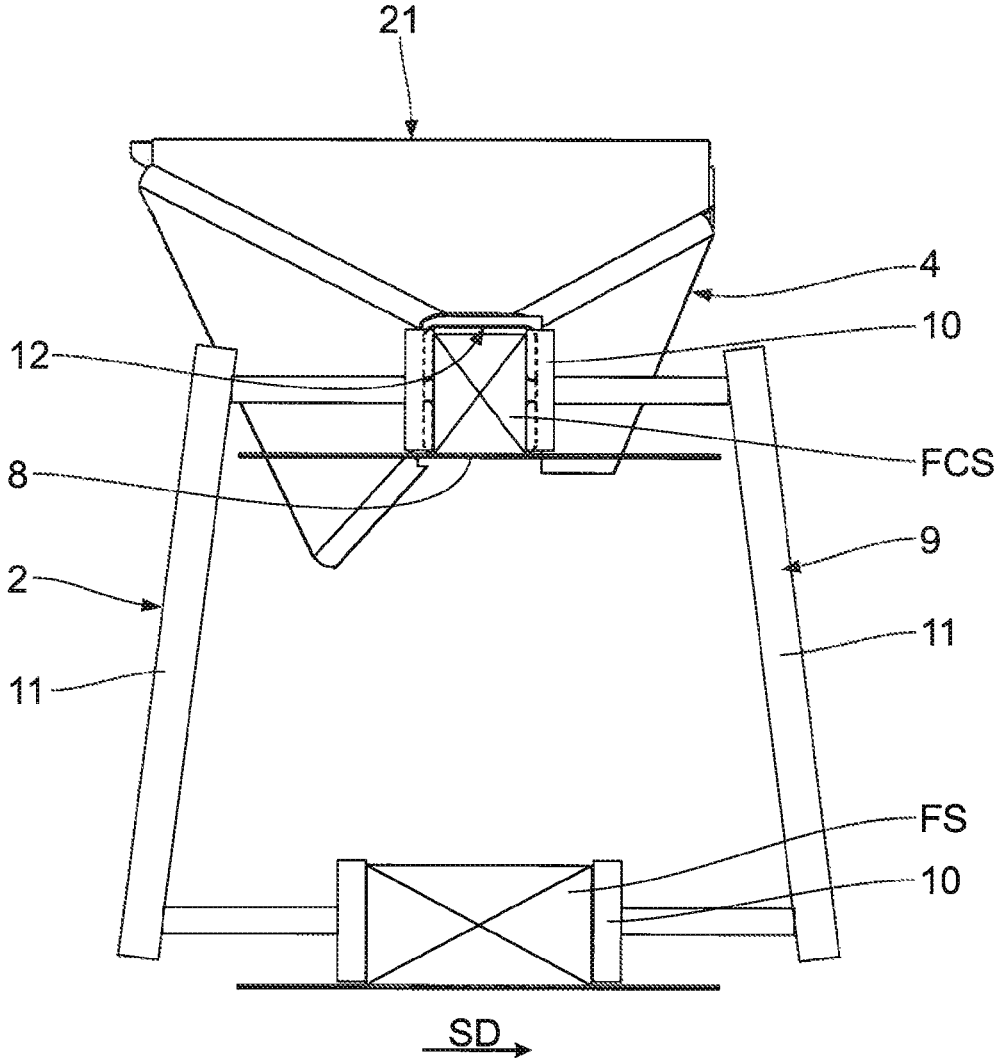
FIG. 4 shows a view of the stack compressing unit in MD direction.

The stack forming unit 1 is likewise only depicted as schematic block as it may be any conventional stacker which piles soft hygienic products, like feminine care products (sanitary napkins, panty liners) particularly in a folded stage. The formed stack FS of these products has a stacking direction SD which is oriented horizontally and transversal to the MD direction (see FIGS. 1 and 4).

The stacks FS formed by this stack forming unit 1 are serially delivered one by one to the stack compressing unit 2 which is explained in detail as follows. As can be seen from FIGS. 2, 3 and especially FIG. 4, the stack compressing unit 2 comprises an elevator stage 8 which is suspended on an elevator bridge 9 with its both ends. As becomes clear from FIG. 4 the elevator stage 8 can be lifted up from a lowered position to an elevated position. Attention is drawn to the fact that the stack compressing unit 2 comprises only one single elevator stage 8 which is depicted in its lowered and elevated position in FIG. 4.

On the elevator stage 8 a telescopic compartment 10 is provided in which the formed stack FS is pushed in its uncompressed state when the elevator stage is at its lowered position. By moving up the elevator bridge 9 and due to the inclination of the columns 11 of the elevator bridge 9 the compartment 10 is pushed together thus vigorously compressing the stacked products to form a compressed stack FCS in the lifted position of the elevator stage 8.

Figure 5:
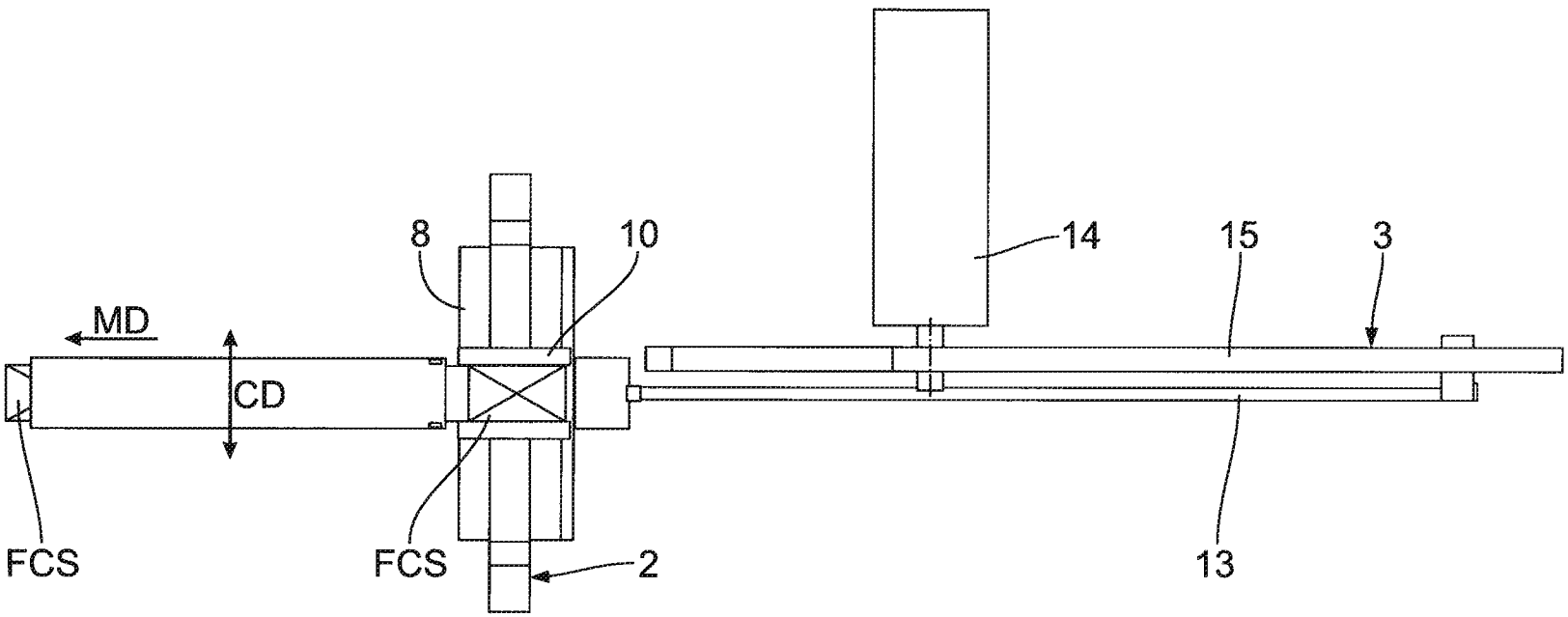
FIG. 5 shows a top plan view of the push rod unit, stack compressing unit and supply tunnel of the packaging device.

In this position the compressed stack FCS is arranged in alignment with a supply tunnel 12. The cross section of this supply tunnel 12 is adapted to the contour of the compressed stack FCS so that same can be transferred through the supply tunnel without changing the compression state appreciably. To move the stacks FCS through the supply tunnel 12 in a row the stack transport unit 3 is implemented by a push rod system comprising a push rod 13 reciprocally driven by a servo motor 14 which is connected to the push rod 13 via an endless drive belt 15 (see FIGS. 1 and 5). By rotating the drive gear 16 of the servo motor 14 in clockwise direction the push rod 13 is moved into the supply tunnel 12, by a countermovement of the drive gear 16 it is retracted again. A neat guidance of the drive belt 15 is achieved by the deflection pulleys 17. Of course, the push rod 13 is linearly guided by slide rails not depicted in the drawing figures.

While the stack is pushed into the tunnel and subsequently into the closed film sleeve, the air pressure increases and inflates the sleeve. Air evacuation channels are advantageously installed to minimize the sleeve's inflation. Those channels may be located inside the supply tunnel covering the complete supply channel length starting from the tunnel entry point to the end. The cross section of those evacuation channels may be constant. For bag widths lower than 80 mm, the air pressure inside the supply tunnel is usually marginal as air can evacuate through the evacuation channel in time. For higher bag widths, it may be advantageous to install vacuum pipes connected to a vacuum system to reduce air pressure because the air may otherwise not evacuate fast enough through the evacuation channel. Those vacuum pipes may be connected to a vacuum system located near the supply tunnel.

The wrapping station 4 serves to feed and guide a packaging film 18 (indicated in hatching in FIGS. 1, 2, 3 and 7) from a stock roll 19 to form a tube-like film envelope 20 around the compressed stacks FCS delivered by the push rod stack transport unit 3 through the supply tunnel 12. To this end the wrapping station 4 includes a funnel-shaped forming shoulder 21 arranged around the supply tunnel 12 with a substantially tapering rectangular cross section design which is shown in detail in FIG. 4 and especially FIG. 6. The forming shoulder 21 tapers against the MD direction and has an inclined top surface 22 and two side faces 23 and 24. The bottom face of the funnel-shaped forming shoulder is more or less left away. The top surface 22 and side faces 23, 24 terminate with a small gap in the vicinity of the supply tunnel 12. Their edges are rounded to prevent the packaging film 18 from damage. Moreover, the funnel edges 25 of the forming shoulder 21 are directed to the MD corners 26 of the supply tunnel 12 which run parallel to the MD direction. As can be seen especially from FIGS. 4 and 6, the top surface 22 of the forming shoulder 21 is an oblique chute, likewise the side faces 23, 24 are skewed and slanted giving an overall asymmetric shape of the funnel-shaped forming shoulder, the purpose of which will be explained in the following on the basis of the run of the packaging film 18. The latter is drawn off from the stock roll 19 and led over an idle roller 27 which is positioned in front of the oblique chute of the top surface 22 of the forming shoulder 21. Accordingly, the film 18 smoothly runs onto the top surface 22 and is folded around the side faces 23, 24 and thus wrapped around the supply tunnel 12. At the inner ends of the forming shoulder 21 the film 18 is sharply bended to change its gross moving direction from against MD direction to MD direction. Thus the tube-like film envelope 20 is formed around the supply tunnel 12. As can be seen from FIG. 6 due to the asymmetric shape of the forming shoulder 21 the longitudinally running edges 29 of the film envelope 20 run along that lower MD corner 26 of the supply tunnel 12 which lies opposite to the largely projecting side of the top surface 22 and side face 23. The packaging film may be made of any suitable and conventional plastic material.

Figure 3:
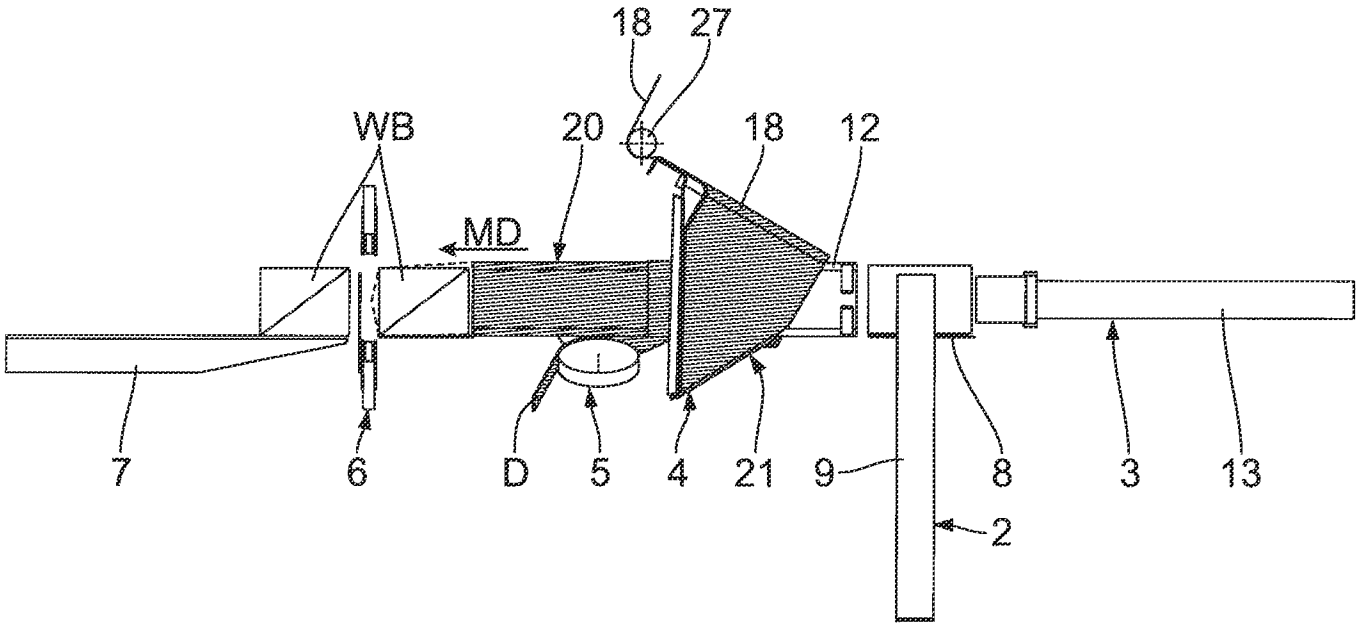
FIG. 3 shows a side elevation of the packaging device.
Figure 6:
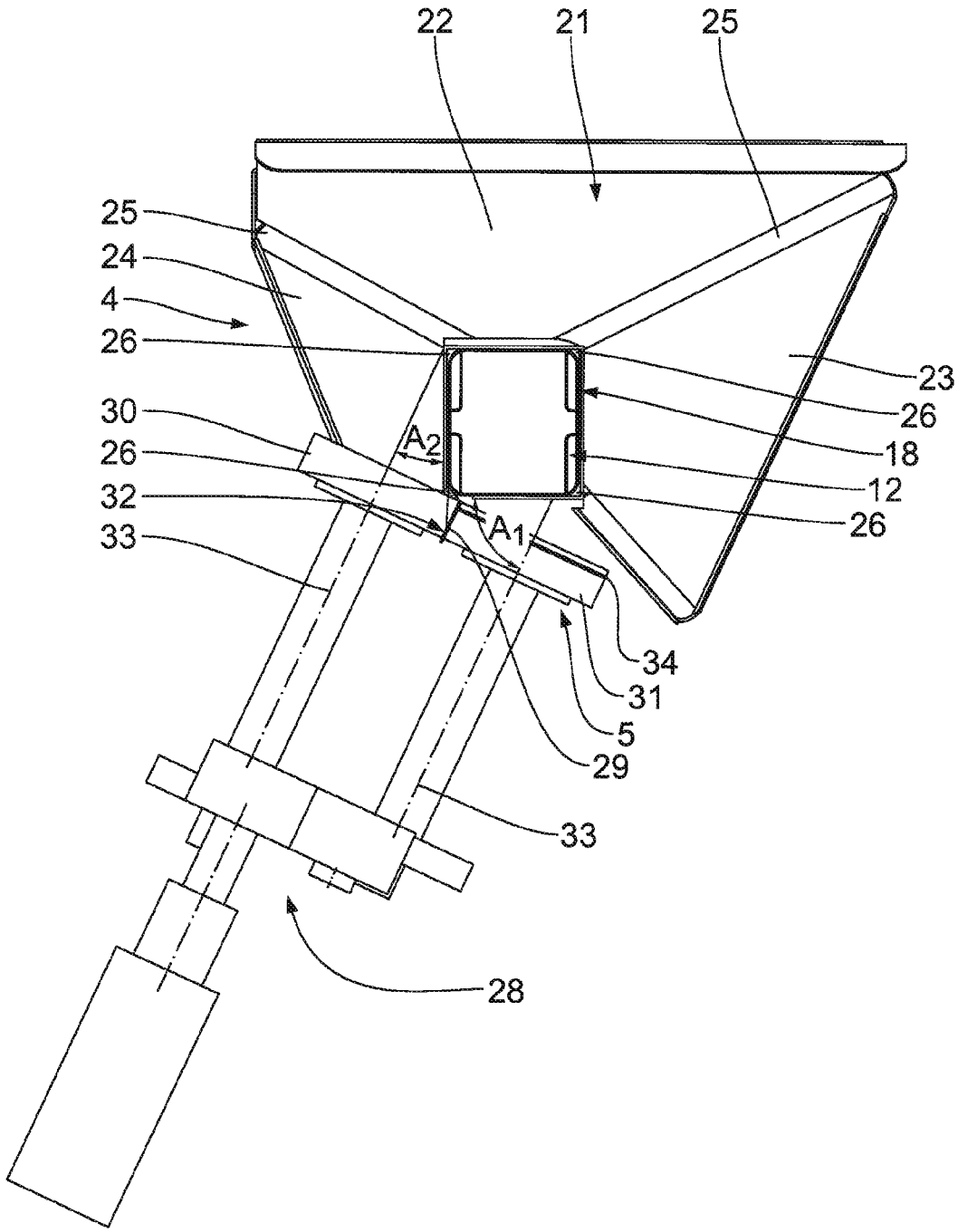
FIG. 6 shows a view of the wrapping station and sealing unit opposite to MD direction.
Figure 7:
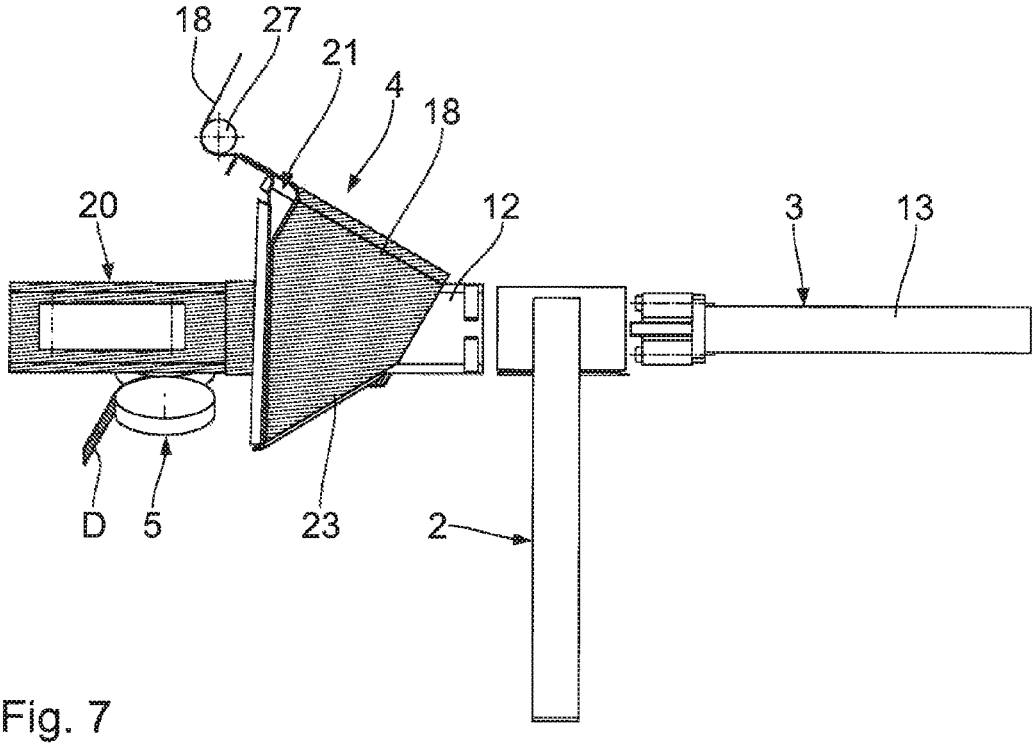

Leaving the forming shoulder 21 the overlapping longitudinally running edges 29 of the film envelope 20 are fed into the MD sealing unit 5 which is depicted in FIGS. 1 and 6. The MD sealing unit 5 comprises a pair of cooperating sealing rollers 30, 31 which form a sealing gap 32 in between and are driven by a sealing roller drive unit 28 (FIG. 6). The longitudinally running edges 29 of the film envelope 20 are fed through this sealing gap 32 and are thus heat sealed together to form a longitudinally closed film tube with an MD seal 35 at the closure corner 46 of the plastic bag to be produced. The parallel axes of rotation 33 of the sealing rollers 30, 31 take acute angles A1 and A2 versa the adjacent side walls of the plastic bag to be produced. As can be seen from FIG. 6 the sealing roller 31 lying below the film envelope 20 comprises a circular cutting blade 34 by which the MD seal 35 of the plastic wrapped bag WB is trimmed to provide for a neat appearance of the bag WB. In FIGS. 2 and 3 the debris D of the trimming action is shown. The longitudinally running edges of the film may be provided with an ink printed on their external surface, so that the sealed bags show no interruption in the artwork across a complete periphery of the bag. In conventional plastic bags, the artwork is normally interrupted along the MD seal line by a band of unprinted material which appears white or transparent. In the present invention, the longitudinally running edges of the film are sealed with their internal faces facing each other, so that the ink printed on the external surface of the film will not interfere with the sealing of the longitudinally running edges.

To assist the motion of the film envelope 20 in synchronism with the incoming compressed stacks FCS a pulling unit 36 is arranged lengthwise of the tube-like film envelope 20. This pulling unit 36 comprises two endless belt conveyors 37 arranged along each side face of the film envelope 20 and engaging same frictionally.

Summing up, with the help of the wrapping station 4 and the MD sealing unit 5 a closed film envelope 20 is formed around the row of compressed stacks FCS being delivered through the supply tunnel 12.

Now to separate and fully close the single wrapped bags WB the CD sealing unit 6 follows the wrapping station 4. The CD sealing unit 6 per se may be conventional and comprises vertically moving sealing bars 38, 39 which not only create a CD seal 41 closing the wrapped bag WB at both opposite ends, but also separates the film envelope 20 between two successive wrapped bags WB. Furtheron, it is to be noted that the CD sealing unit 6 comprises side gusset blades 40 which engage the film envelope 20 to form neat gussets 47 (FIG. 8) at the film envelope 20.

In the method for producing a plastic bag according to the invention, the CD sealing unit 6 may apply the CD seal 41 at the film envelope 20 before the compressed stack FCS of products is pushed through the supply tunnel 12 into the film tube. For this sake, the CD sealing unit 6 is reciprocally moveable in the machine direction so that it can travel together with the film envelope 20 in machine direction during the sealing process. Thus, when sealing the trailing CD seal 41 of a bag, e.g. bag WB left of the sealing unit 6 in FIG. 3—a sack-like tube is presented in front of the supply tunnel 12. Into this sack a highly compressed stack FCS can be pushed in by the push rod 13 through the supply tunnel 12 hitting the bottom of the sack-like tube formed by the CD seal 41. Pushing the stack FCS on the right side of the CD sealing unit 6 further allows the CD sealing unit 6 to apply the second CD seal 41 behind this stack simultaneously forming the sack-like tube ready for pushing in the next stack FCS. Thus, the second CD seal 41 of the wrapped bag WB leaving the CD sealing unit 6 simultaneously provides for the first CD seal 41 to form the transversally closed leading end of the tube for the following Wrapped bag WB.

The packing of a stack FS of feminine care products or the like is shortly summarized as follows: the uncompressed stack FS is formed by a conventional stack forming unit 1. The stack FS is pushed into the telescopic compartment 10 of the elevator stage 8 and then moved upwards. Accordingly, the stack FS is compressed. After that the push rod 13 pushes the compressed stack FCS through the supply tunnel 12 and delivers it into the tube-like film envelope 20. The stack FCS is positioned a short distance behind the preceding stack in the film envelope 20. During the feed motion of the film envelope 20 the longitudinally running edges 29 are provided with a MD seal 35 and the CD seal 41 at the leading edge of a respective bag WB, before the stacks FCS are pushed in. Finally, the second CD seal 41 at the trailing edge is created by the CD sealing unit 6 thus finalizing the bag WB.

Figure 8:
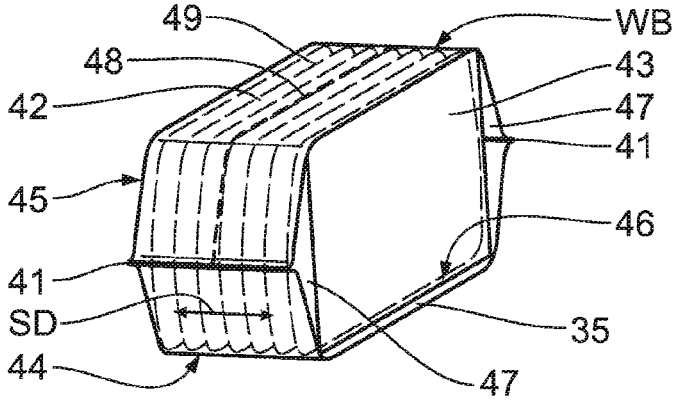
FIG. 8 shows a perspective view of a plastic bag produced with the packaging device of FIG. 1-7.

FIG. 8 shows a completed wrapped bag WB with four integral side faces 42 through 45 and the MD seal 35 at the so-called closure edge which is the lower one of the longitudinal edges or so-called MD corners 26. Furtheron, there are two CD seals 41 with side gussets 47 applied at the small faces of the wrapped bag WB. The CD seals may be without trim, i.e. the trim extending outwardly may have a width less than 2 mm, or 1 mm, along the length of the trim.

Opening means may advantageously be present, on one or more side faces 42 to 45, for example a continuous perforated line 48 in the MD on the top face 42 as represented on FIG. 8. The stock roll 19 may comprise such a continuous perforated line along its whole length, so that it is not necessary to perforate the film on the bagging line, or the perforation may be done on the same packing line as the roll of film is unrolled. The opening means 48 may be orientated parallel to the plane defined by the products 49. This was found to be especially advantageous when the stack of product is in a compressed state, as in such configuration the compressed products were found to be easier to take out of the bag with the opening means orientated in the same plane. In FIG. 8, the perforated line is shown as passing through the middle of the top panel 42, but it could of course also be located asymmetrically on either side of the middle of the top panel, or in any place of any of the side panels 43 to 45 is wished.

Figure 9:
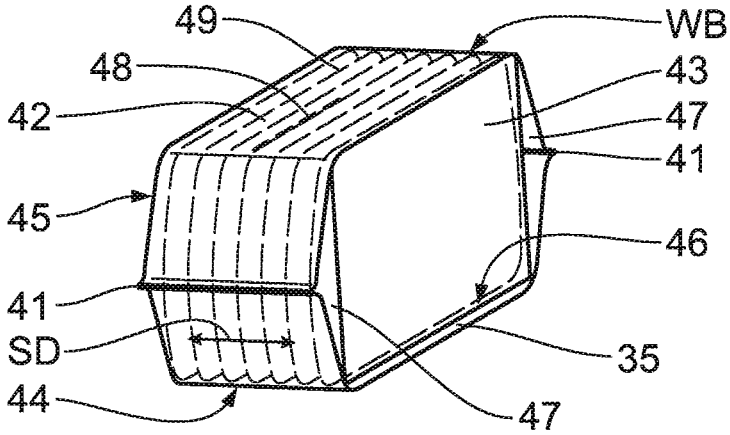
FIGS. 9 to 15 show other embodiments of plastic bags which may be produced according to the invention.

FIG. 9 shows a bag with a perforated line segment for opening and dispensing enclosed products that is applied in machine direction (MD). The perforation position can be anywhere across the longitudinal axis of the bag, located in either the side panels 42-45 or in the front or back panel. Having a discontinuous perforation may be advantageous to allow consumers to only partially open the bag without it losing its structural integrity.

Figure 10:
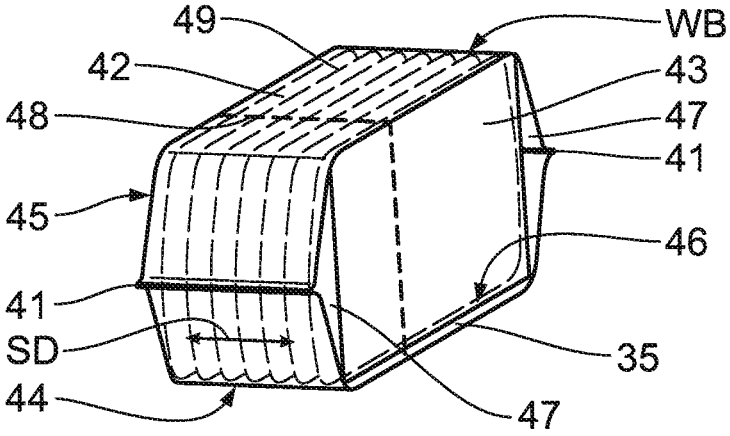

FIG. 10 shows a bag with a perforation for opening and dispensing enclosed products that is applied in cross machine direction (CD) and is continuous across the entire circumference of the bag. The perforation position can be anywhere within the circumference axis of the bag (front, middle or back of the bag). The perforation may be applied on the stock roll of material 19 before installing the roll on the line, or may be applied on the roll of material on the bagging line.

Figure 11:
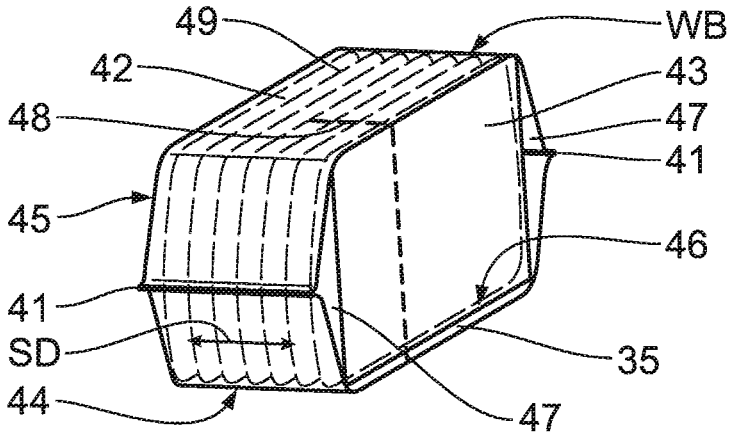

FIG. 11 shows a bag with a perforated line segment for opening and dispensing enclosed products that is applied in cross machine direction (CD). The perforations can be placed anywhere within the circumference axis of the pack (top, middle or bottom of the pack). Having a discontinuous perforation may be advantageous to allow consumers to only partially open the bag without losing its structural integrity.

Figure 12:
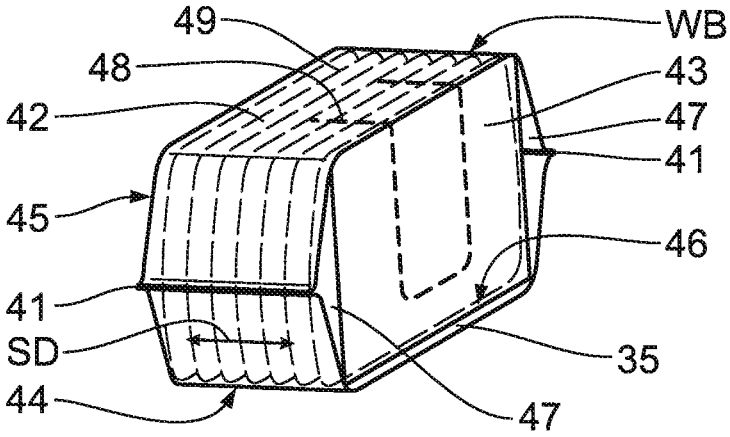

FIG. 12 shows a bag that contains perforations for opening and dispensing enclosed products that define a two dimensional area on the surface of the bag. The user can open the bag along the perforations to form a dispensing flap. The shape and CD/MD position of the perforation can be designed against product dimensions and consumer needs for convenient removal and can be anywhere on the pack. Having a two dimensional area defined by the perforations can allow consumers to partially open the bag without it losing its structural integrity.

Figure 13:
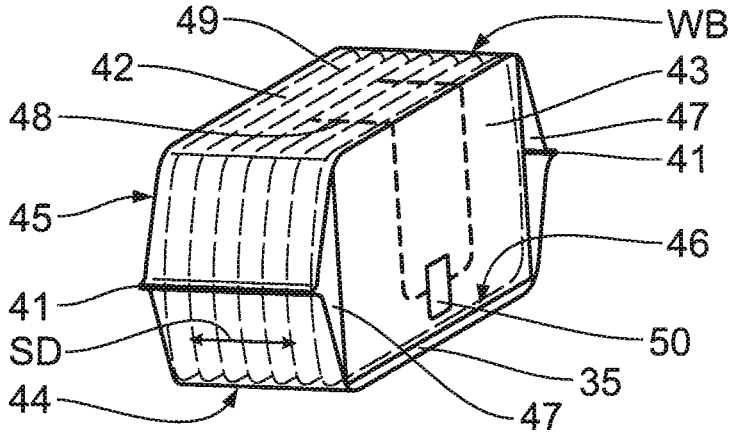

FIG. 13 shows a bag similar to the bag of FIG. 12, where in addition the perforated flap is provided with an resealable tape 50 that enables easy opening as well as reclosing of the dispensing flap by the consumer, for example using a multi-use glue component. Material, shape and positioning of the tape can be defined against the consumer handling and bag design needs. The tape 50 may be applied on-line or off-line.

Figure 14:
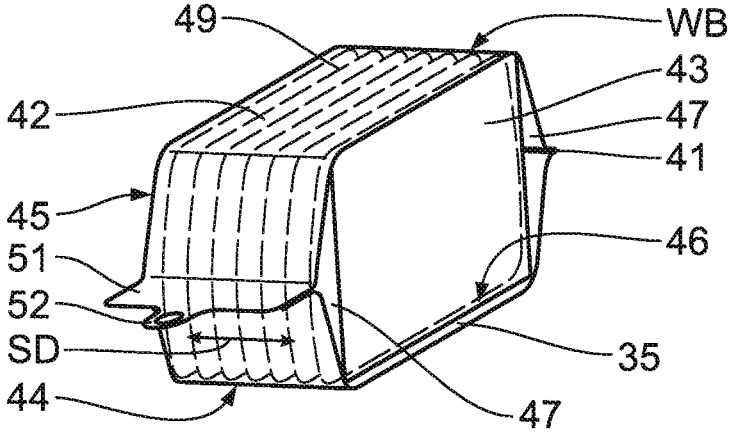

FIG. 14 shows a bag that contains an extended cross seal trim area 51 on one of the CD seal (but it could also be on both CD seals). The trim width may be for example between 5 and 100 mm wide, and consisting of the same material as the rest of the bag. The extended trim can be printed or unprinted and have various kinds of shapes (rectangular, triangular, oval shaped, as needed for design and functionality intend). The extending space may be used to place a hanging means 52 by introducing at least one hole. Of course it can also be used for adding a printed decoration, or as advertisement space. The trim extension can be made on-line by the use of a redesigned cross seal station introducing a cross-seal adapted for forming the desired trim.

Figure 15:
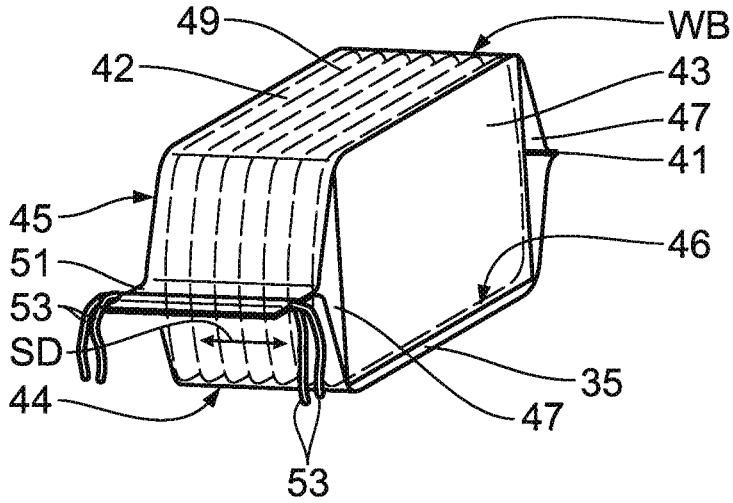

Instead or in addition to hanging means, the extended trim area may be provided with other functionality using added components, which may be applied on-line. The added functionality components can be of various kinds serving different purposes, for example: ribbon or drawstring-like materials for decorative and/or reclosability function as shown on FIG. 15, zip-lock base components for reclosability function, "hook and loop" fastener base components for reclosability function etc. . . . if such opening and closing means are provided on the extended trim area, a perforated line 48 may not be necessary.

The on-line production of the described packs may allow the economic and efficient production of bags appealing to consumers while at the same time delivering functionality during daily use.

The plastic bag can comprise an artwork which is continuous in the area of the MD seal. By continuous, it is meant that the artwork is not interrupted in the area of the MD seal, e.g. by a non-printed band (usually white or transparent) as is usual for commercial prior products. The artwork may be obtained by conventional technique, for example by printing the external surface of the film with a suitable ink.

In-Bag Compression Measurement Protocol

This protocol defines the required actions and measurements in order to measure the In-Bag Compression (IBC). The method described is applicable for any kind of bag making technology.

The IBC quantifies the amount of compression between the "free&fresh" products at a defined point during production and the products packed in the primary bag after the bagging process.

The number is given as a delta (in %) between free&fresh height and bagged stack height. The IBC definition does not assume/describe any compression other than in stack height.

For the free&fresh products caliper measurements, a sample of 5 products are collected during production at the stacker chain, and measured within 5 minutes after production.

- Products cannot be taken from any other reject in the converter because pressurized air significantly changes product calipers
- Products cannot be measured after more than 5 minutes after production as product caliper may change with increased time
- Products cannot be sampled out of bags or any other in-between storage condition as this will not allow proper IBC definition.

The bags have to be sampled during the same production run as the pads, they cannot be stored in between in cases but need to be sampled after the bagger and measured directly after (within 60 minutes after production).

The measurement of the stack height of the 5 free&fresh products and filled bags can be made with any standard motorized test stand normally used for this purpose. The motorized test stand comprises a product holder and a compression plate which is slidable vertically. The equipment assesses the distance between the base plate and the contact point between the test piece and compression plate. This device measures Force and Length at the same time. This type of measuring device is common in the field of absorbent articles to make caliper and height measurements. A suitable device may be bought for example at Alluris Gmbh & co. Kg, of Baslerstrasse 65, 79100, Freiburg, Germany.

For the purpose of this protocol, all thickness measurements are made at a load of 1 N using a circular compression plate with a diameter of 150 mm. The sliding stage is set up to go down at a rate of 180 mm/mn until the start position which is chosen to be close to the height of the test piece. The speed then decreases to 12 mm/mn and once the compression plate gets in contact with test pieces, the resistance applied by the test piece to the sliding stage is permanently measured by the load cell connected to the compression plate. Such a low speed as 12 mm/mn is needed in order to be able to detect the precise moment when the reaction force of 1N is reached.

Of course, the bags have to be placed properly in the measuring device (stack height in bag always vertical). Temperature and relative humidity level should be the same for the measurement of the height of the stack of fresh&free articles and the height of the bag, for example 21° C. and 30% relative humidity.

The IBC is defined as the delta (in %) between the Stack Height of the Fresh&Free products and the Stack Height of the products in the primary bag, as calculated with the below equation:

$$IBC(\%) = 100 \times \left(1 - \frac{SH_B \times 5}{SH_{F\&F} \times Count_B}\right)$$

SHB=Stack Height in Bag

SHF&F=Stack Height Fresh&Free Products (measured with 5 articles)

countB=Count in bag

The Stack Height in Bag can be directly measured as the height of the bag using a test stand as indicated above. The thickness of the wrapping material is in general negligible, but can be subtracted when this is not the case.

The Stack Height Fresh&Free Products is measured using a stack of 5 products using a test stand, as indicated above.

For example, if the measured SHF&F (5 articles) is 50 mm and the Stack Height in Bag SHB is 80 mm (bag containing 10 articles), the IBC is 20% (=100*(1-80*5/(50*10))).

The dimensions and values disclosed herein are not to be understood as being strictly limited to the exact numerical values recited. Instead, unless otherwise specified, each such dimension is intended to mean both the recited value and a functionally equivalent range surrounding that value.

For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning of definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A packaging device for packing stacked soft hygienic products into a plastic bag made of an endless film, said packaging device comprising:

i) a stack forming unit for bundling products into a stack, ii) a stack transport unit for supplying the formed stack to iii) a wrapping station, the wrapping station including a supply tunnel through which the formed stacks are delivered to the wrapping station in a row, a film feed for feeding the film from a film stock, a funnel-shaped forming shoulder arranged around the supply tunnel with a substantially rectangular cross section design, over which the fed film is drawn to guide the film onto the supply tunnel and to form a tube-like film envelope around the stacks leaving the supply tunnel, iv) a machine direction sealing unit for sealing the longitudinally running edges of the tube-like film envelope, and v) a cross direction sealing unit for forming and sealing the crosswise running edges of the tube-like film envelope for each plastic bag simultaneously separating the sequenced bags, wherein vi) the funnel-shaped forming shoulder has an asymmetric shape to guide the longitudinally running edges of the film to align with one longitudinal corner of the supply tunnel and the stacks, respectively, and vii) the machine direction sealing unit is located in the vicinity of said longitudinal corner to produce a machine direction seal at the plastic bag running along a longitudinal closure corner of each plastic bag.

2. The packaging device of claim 1, wherein the funnel edges of the forming shoulder terminate at the machine direction corners of the supply tunnel.

3. The packaging device of claim 1, wherein the top surface of the forming shoulder is an oblique chute.

4. The packaging device of claim 3, wherein an idle roller is provided in front of the oblique chute top surface.

5. The packaging device of claim 1, wherein the MD sealing unit comprises a pair of cooperating sealing rollers, which form a sealing gap in front of the longitudinal closure corner for the longitudinally running edges of the tube-like film envelope of the bag and the parallel axes of rotation of which sealing rollers take acute angles versa the adjacent side walls of the plastic bag.

6. The packaging device of claim 5, wherein one of the sealing rollers has a circular cutting blade to incorporate a trim function into the sealing unit.

7. The packaging device of claim 1, wherein at least one pulling unit arranged lengthwise of the tube-like film envelope to transport same in synchronism with the stacks leaving the supply tunnel.

8. A packaging device according to claim 7, wherein the pulling unit comprises endless belt conveyors engaging the side portions of the tube-like film envelope.

* * * * *